US006835132B2

(12) United States Patent
Bennett

(10) Patent No.: US 6,835,132 B2
(45) Date of Patent: Dec. 28, 2004

(54) GAMING MACHINE WITH PLAYER OPERABLE CHANGING GRAPHICAL BONUS AMOUNT INDICATOR

(75) Inventor: Nicholas Bennett, New South Wales (AU)

(73) Assignee: Aristocrat Technologies Australia PTY Ltd., New South Wales (AU)

( * ) Notice: Subject to any disclaimer, the term of this patent is extended or adjusted under 35 U.S.C. 154(b) by 135 days.

(21) Appl. No.: 09/829,126

(22) Filed: Apr. 9, 2001

(65) Prior Publication Data

US 2001/0049298 A1 Dec. 6, 2001

(30) Foreign Application Priority Data

Apr. 7, 2000 (AU) ..... PQ6758

(51) Int. Cl.[7] ..... A63F 9/24
(52) U.S. Cl. ..... 463/16; 463/25; 463/30
(58) Field of Search ..... 463/25, 30, 16; 273/138.2

(56) References Cited

U.S. PATENT DOCUMENTS 4,582,324 A * 4/1986 Koza et al. ..... 463/16
4,743,024 A * 5/1988 Helm et al. ..... 273/143 R
5,743,800 A * 4/1998 Huard et al. ..... 463/26
5,779,549 A * 7/1998 Walker et al. ..... 463/42
5,851,148 A * 12/1998 Brune et al. ..... 463/25
5,855,514 A * 1/1999 Kamille ..... 463/17
6,039,649 A * 3/2000 Schulze ..... 280/748
6,142,873 A * 11/2000 Weiss et al. ..... 463/20

OTHER PUBLICATIONS

Range Game htt;?/gescentral.net/range.htm.*
Range Game, http://gscentral.net/range.htm.*
Marshall Fey, Slot Machines, A History of the First 100 Years, 1983, Liberty Belle Press, p. 165.*

* cited by examiner

*Primary Examiner*—Jessica Harrison
*Assistant Examiner*—Corbett B. Coburn

(57) ABSTRACT

A gaming machine has a display and a game controller arranged to control images displayed on the display. The game controller is arranged to play a game wherein one or more random events are caused to be displayed on the display and, if a predefined winning event results, the machine awards a prize. The gaming machine includes a feature of a changing representation of the awarding of the prize and a player-operable control device which upon manipulation by a player, controls an outcome of the representation to determine an amount awarded to the player.

17 Claims, 14 Drawing Sheets

GAMING MACHINE WITH PLAYER OPERABLE CHANGING GRAPHICAL BONUS AMOUNT INDICATOR

FIELD OF THE INVENTION

This invention relates to a gaming machine. More particularly, the invention relates to a gaming machine and to an improved feature of such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often play close attention to the popularity of various games with their patrons. Therefore, gaming machine manufacturers are keen to devise games which are popular with the players as a mechanism for improving sales, retaining customers and attracting new customers.

SUMMARY OF THE INVENTION

According to the invention, there is provided a gaming machine having a display means and a game control means arranged to control images displayed on the display means, the game control means being arranged to play a game wherein one or more random events are caused to be displayed on the display means and, if a redefined winning event results, the machine awards a prize, the gaming machine being characterized in that it includes a feature of a changing representation of the awarding of the prize and a player-operable control device which, upon manipulation by a player, controls an outcome of the representation to determine an amount awarded to the player.

The representation may be a representation of a win meter. The representation may be in the standard form of serially incrementing digits. Instead, or in addition, the representation may be a graphical display representing a changing award. In one embodiment of the invention, the representation may be in the form of a mercury-type thermometer where a representation of an increasing mercury column represents an increasing prize. In another embodiment, the graphical representation may represent a skydiver leaping from an aeroplane. Yet a further embodiment may relate to a share purchase game.

In this specification, by "graphical display" is meant, unless the context clearly indicates otherwise, an animation of an object or event having a characteristic which changes or an animation of a being carrying out an activity. Further, the term "amount" is to be understood, unless the context clearly indicates otherwise, as including a zero amount.

The amount represented by the graphical display, by where it is stopped by the player, may be awarded to the player as the prize.

The game control means may select a threshold value such that, when that threshold value is reached by the graphical display without having being stopped by the player, a losing outcome results. In this specification, unless the context clearly indicates otherwise, the term losing outcome is to be understood as meaning no prize or a consolation prize. Thus, a random number may be selected as the threshold value by the game control means, the random number falling in a predetermined range from one to a highest possible value.

The graphical display may commence changing and the player may be able to stop the graphical display at any time by means of the control device, the arrangement being such that, if the graphical display reaches the threshold value, the losing outcome results but, if the player operates the control device before the threshold value is reached, the player may be awarded the amount represented by the graphical display at the time that the control device is operated.

It is to be noted that the rate at which the graphical display changes may be variable and is set by the game control means. Further, the game control means may be operable to cause the losing outcome to result even if the player operates the control device before the threshold value has been reached.

Should the player stop the representation before the threshold value is reached, the game control means may cause the selected threshold value to be displayed so that the player can ascertain when the losing result would have resulted.

The control device may be an actuator operable by the player to stop changes in the representation.

The feature may be triggered upon the occurrence of a trigger condition arising in a base game. The trigger condition may have an effect on the prizes awarded in the feature. For example, if the trigger condition is the presence of a number of scatter symbols in the base game, the more scatter symbols that are present, the more favourable it may be for the player in the feature game.

The feature may be played as a tournament across a bank of linked gaming machines but may also be applicable to a stand-alone gaming machine.

BRIEF DESCRIPTION OF THE DRAWINGS

The invention is now described, by way of example, with reference to the accompanying drawings in which.

DETAILED DESCRIPTION OF THE DRAWINGS

Figure 1:
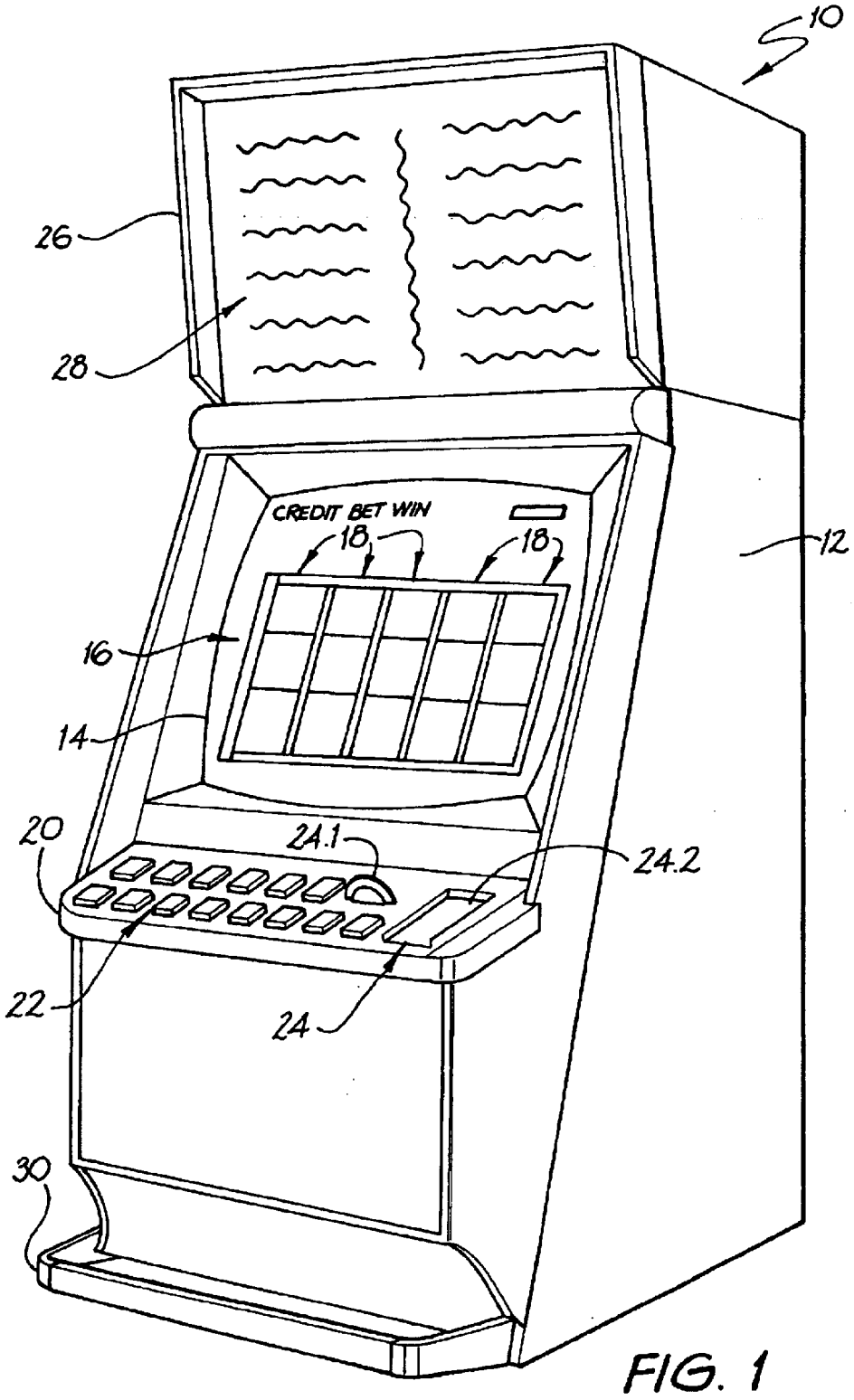
FIG. 1 shows a three dimensional view of a gaming machine, in accordance with the invention.

In FIG. 1, reference numeral 10 generally designates a gaming machine, including a game, in accordance with the invention. The machine 10 includes a console 12 having a video display unit 14 on which a game 16 is played, in use. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
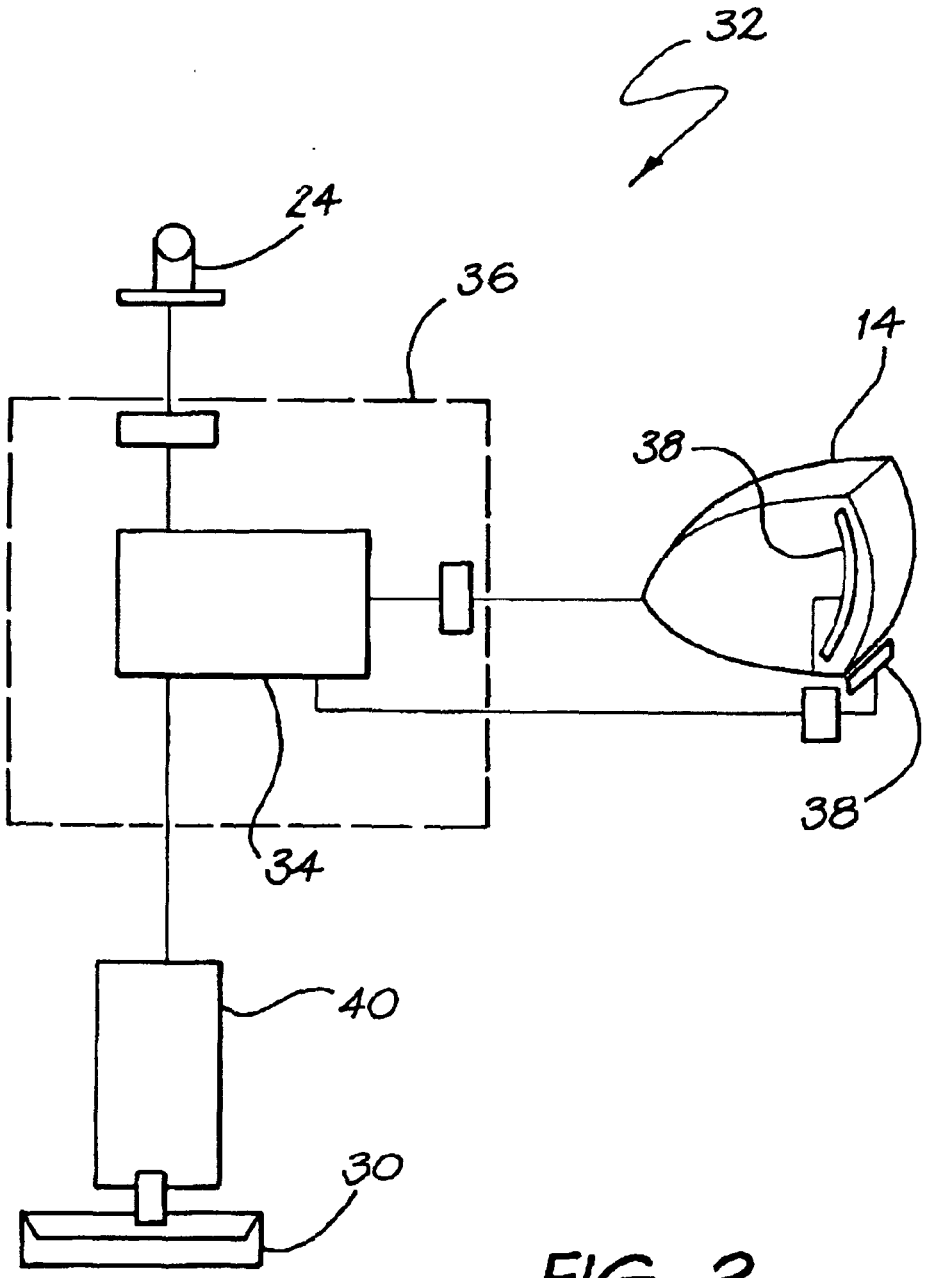
FIG. 2 shows a block diagram of a control circuit of the gaming machine.
Figure 3A:
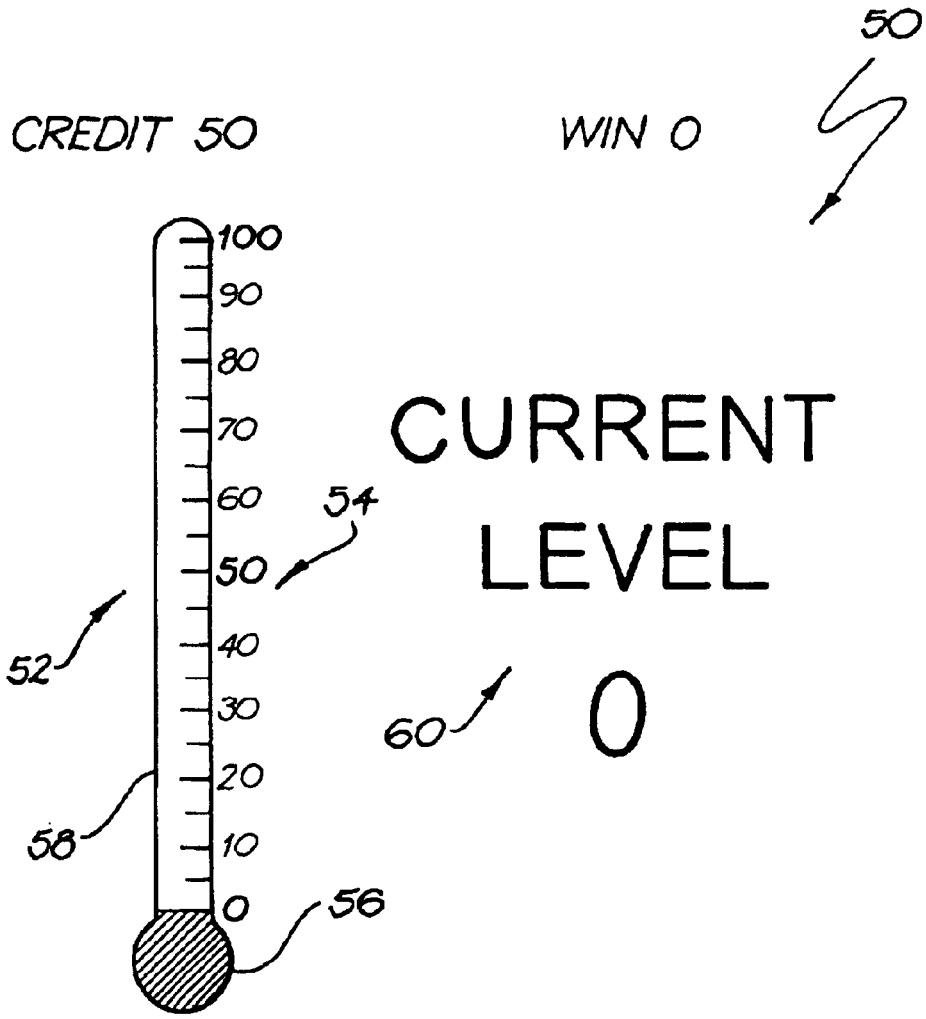
FIGS. 3*a* to 3*d* show screen displays of a first example of a first embodiment of a feature game played on the gaming machine of FIG. 1.
Figure 3B:
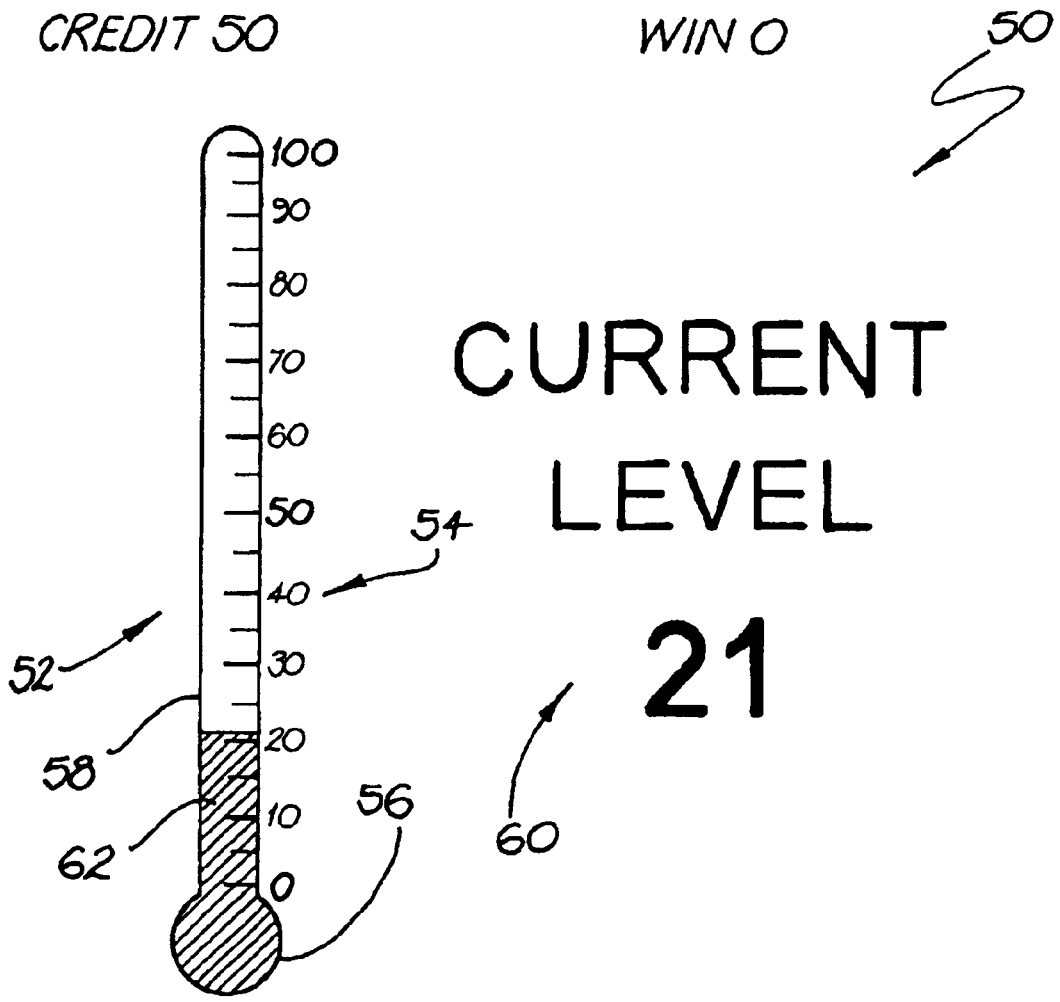
Figure 3C:
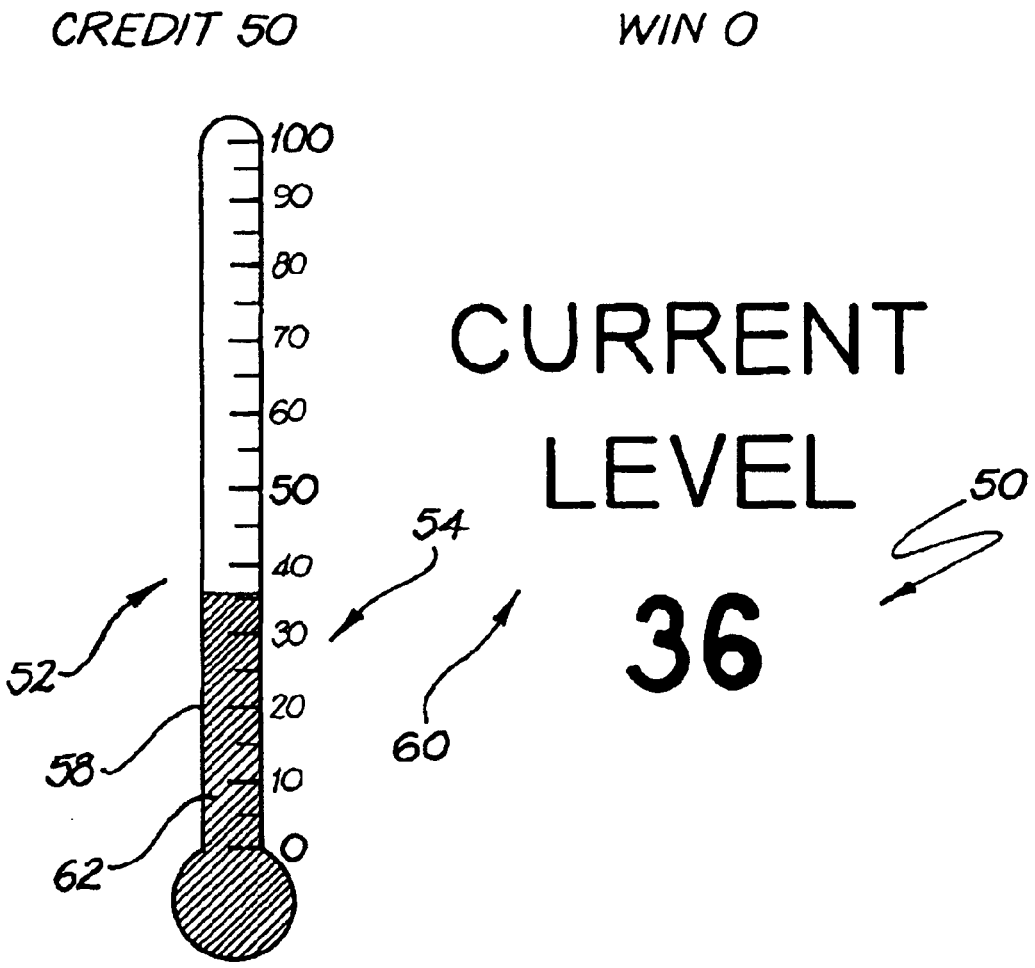
Figure 3D:
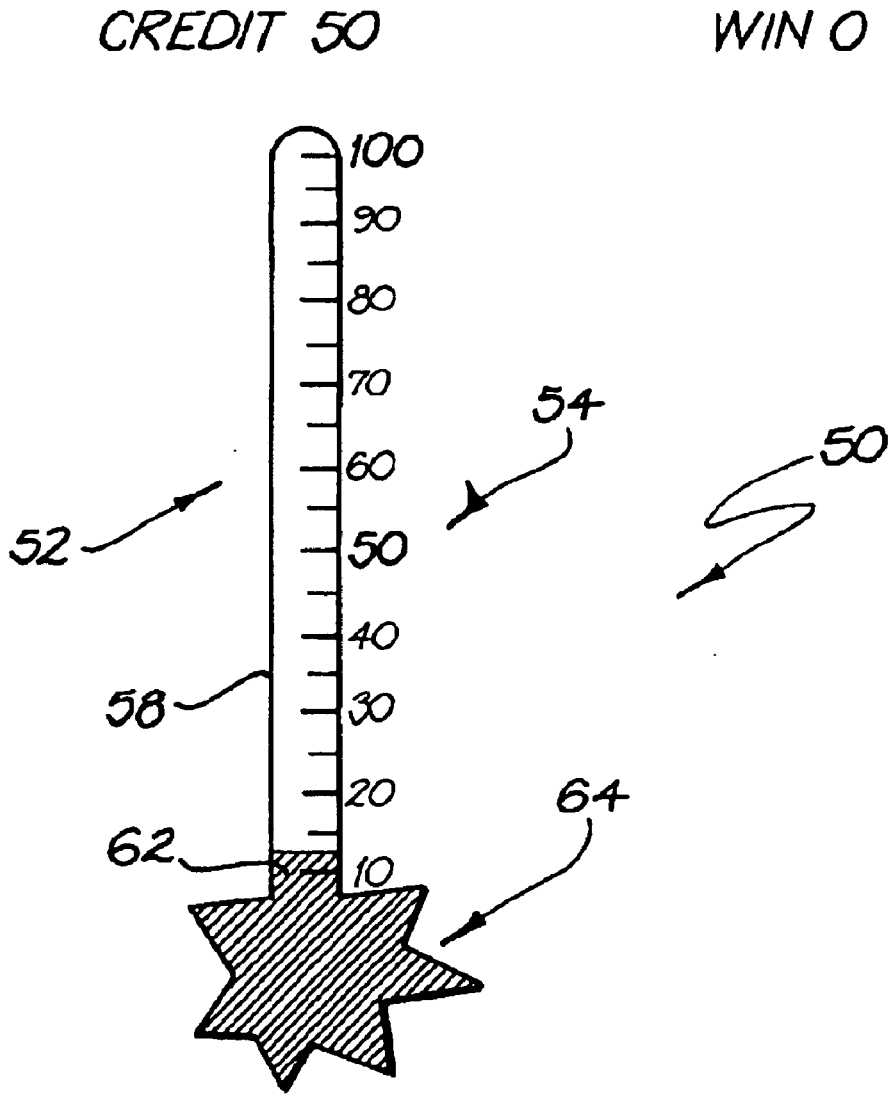

Referring now to FIG. 2 of the drawings, a control means or control circuit 32 is illustrated. A program which implements the game and user interface is run on a processor 34 of the control circuit 32. The processor 34 forms part of a controller 36 which drives the screen of the video display unit 14 and which receives input signals from sensors 38. The sensors 38 include sensors associated with the bank 22 of buttons and touch sensors mounted in the screen. The controller 36 also receives input pulses from the mechanism 24 indicating that a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

Referring now to FIGS. 3*a* to 3*d* of the drawings a first example of a feature game played on the gaming machine 10 is illustrated. A screen display of the feature game is designated generally by the reference numeral 50.

The feature game arises as a result of a trigger condition occurring in the base game. For example, the trigger condition may be the presence of three scatter symbols on the reels 18 of the base game 16.

When the trigger condition occurs, the feature game is displayed on the screen of the video display unit 14. The feature game 50 has a representation in the form of a thermometer 52 having gradations 54. The representation of the thermometer 52 has a bulb 56 and a column 58. The gradations 54 are marked on the column 58. A message 60 is also indicated on the screen display 50.

The processor 34 of the control circuit 32 determines a random level. In the example illustrated in FIGS. 3 and 4 the random level is set at 36° C. The random level is set as a random number between one and the maximum gradation of 100° C.

The player starts the feature game either by touching an appropriate message on the screen 50 or by manipulating an appropriate button of the bank 22 of buttons. When the feature starts, an indicator 62 of "mercury" rises in the column 58 of the thermometer 52. The player by means of an actuator, such as one of the buttons of the bank 22 of buttons, can, at any time, decide to stop the indicator 62 of the thermometer 52.

In the example illustrated in FIG. 3 of the drawings, the random number selected by the control circuit 30 is 36° C. Thus, the indicator 62 continues rising in the column 58 until 36° C. is reached. If the player has not pressed the actuator before 36° C. is reached as shown in FIG. 3*c* to stop the indicator 62 rising in the column 58, the feature ends. No win is awarded and the screen display reverts to that of the base game. The lack of a prize may be indicated by an appropriate animation of the thermometer 52, for example, by the bulb 56 exploding as indicated at 64 in FIG. 3*d* of the drawings.

Figure 4A:
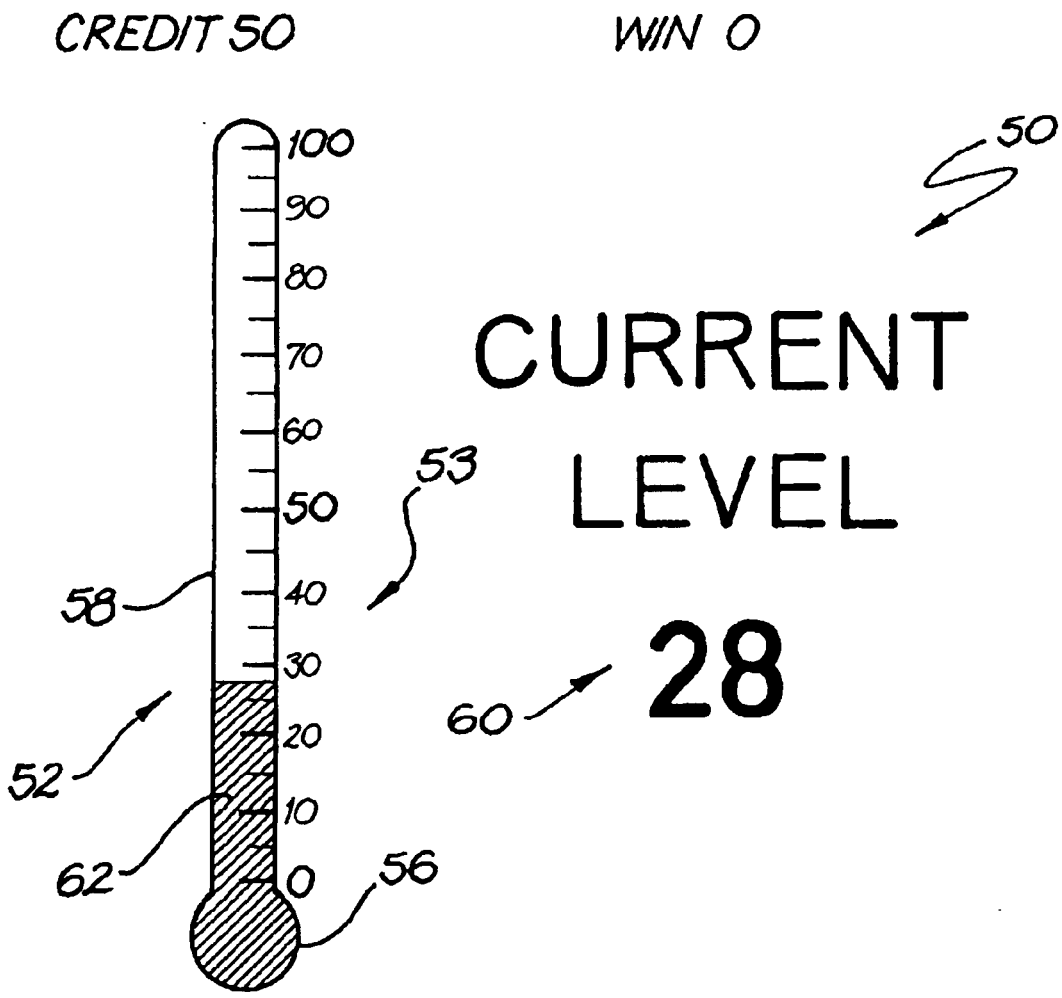
FIGS. 4*a* and 4*b* show screen displays of a second example of the first embodiment of the feature game.
Figure 4B:
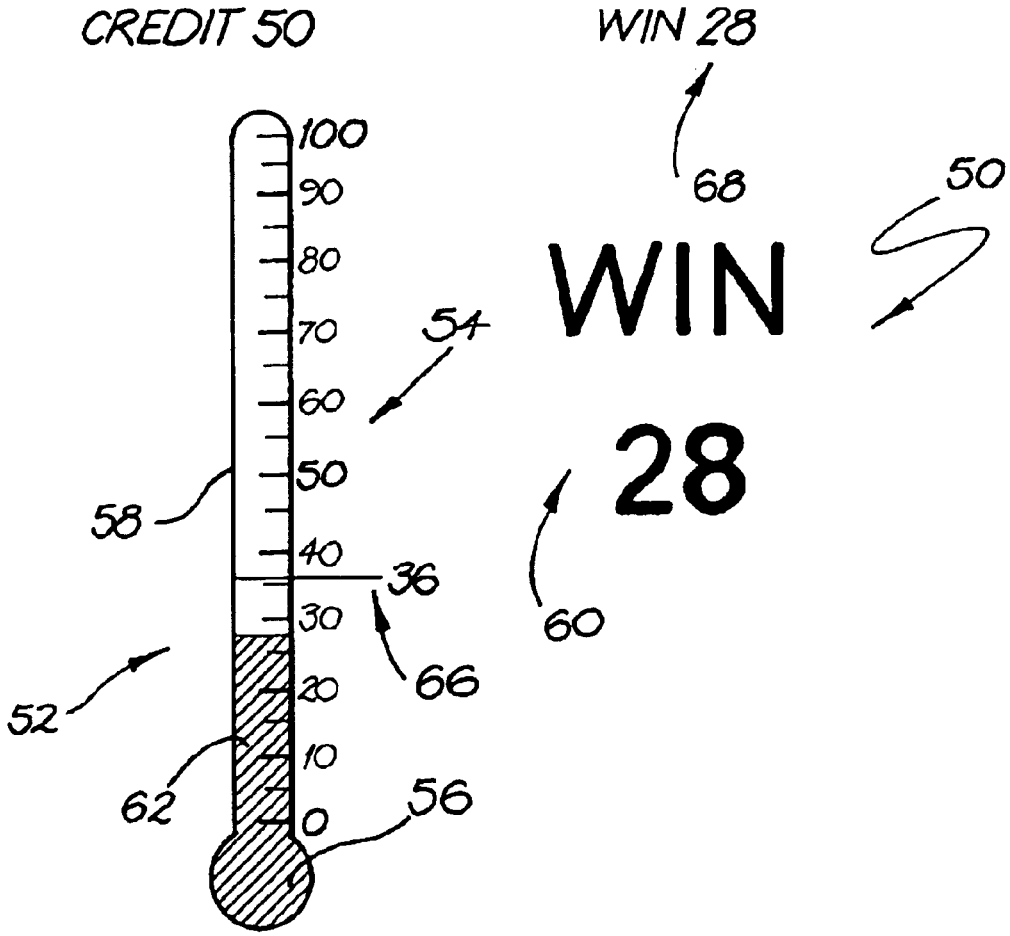

Referring now to FIGS. 4*a* and 4*b* of the drawings, a further example is shown, With reference to FIGS. 3*a* to 3*d* of the drawings, like reference numerals refer to like parts, unless otherwise specified.

In this example, the random number is again selected as 36° C. However, in this case, when the indicator 62 reaches 28° C., the player stops the indicator 62 rising in the column 58 of the thermometer 52. Consequently, the player is awarded a prize of twenty eight credits and a win meter 68 of the gaming machine 10 is incremented. Also, the random number as selected by the control circuit 32 of the gaming machine 10 is displayed, as indicated at 66 in FIG. 4*b* of the drawings.

In FIGS. 5*a* to 5*d*, a second embodiment of a feature game is illustrated.

In this embodiment of the game, an initial screen display 70 shows an animation of a skydiver 72 about to jump from an aeroplane 74. The player controls the point at which the skydiver 72 "pulls" the rip cord on the skydiver's parachute by pushing a button of the bank 22 of buttons or by using a touch screen sensor 38. If the rip cord is pulled in time for the parachute to open and save the skydiver from hitting the ground, the player wins a prize which is dependent upon how close to the ground the skydiver 72 got before the rip cord was pulled. However, if the parachute is opened too late to prevent the skydiver from hitting the ground, then only a consolation prize is given. Hence, in contrast to the embodiment described with reference to FIGS. 3 and 4 above, a consolation prize is paid.

For example, a prize win may be in the range of one hundred to two hundred credits. However, for a failed jump the player may still be awarded a consolation prize of ten credits.

When the feature game commences, an internal meter, which is not visible to the player, is initialised to one hundred credits. After the initial animation has commenced, the credit meter is incremented at a predetermined rate. For example, the machine has five different rates at which the internal meter is incremented. The amount by which the amount on the credit meter increments depends on the rate selected. The rate is selected by the machine and the rates are defined as a first rate which increments by one credit, a second rate which increments by two credits, a third rate which increments by four credits, a fourth rate which increments by five credits and a fifth rate which increments by ten credits. The machine 10 chooses a random number in the range one to five representing the chosen rate.

Further, in order to add a random factor into the feature game so that it is not entirely dependent upon player skill, the gaming machine 10 still picks a random number that will be the maximum obtainable prize for that session as described with reference to the previous embodiment. Instead, the player may potentially be able to win a maximum amount from any session except that the rate of increment from the lower bound to the upper bound, as described above may vary depending on the rate selected by the machine 10.

Figure 5A:
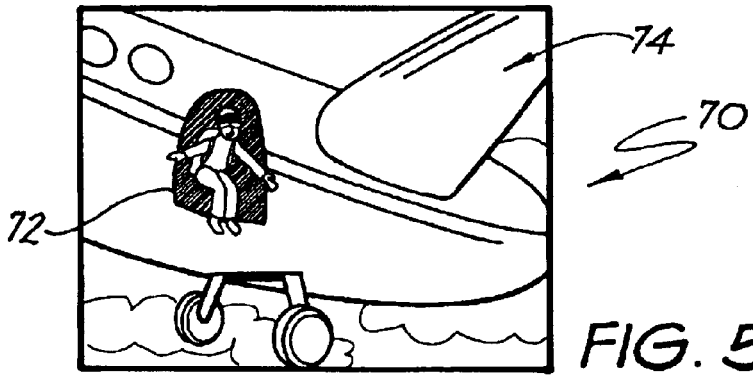
FIGS. 5*a* to 5*d* show screen displays of a second embodiment of a feature game played on the gaming machine of FIG. 1.
Figure 5B:
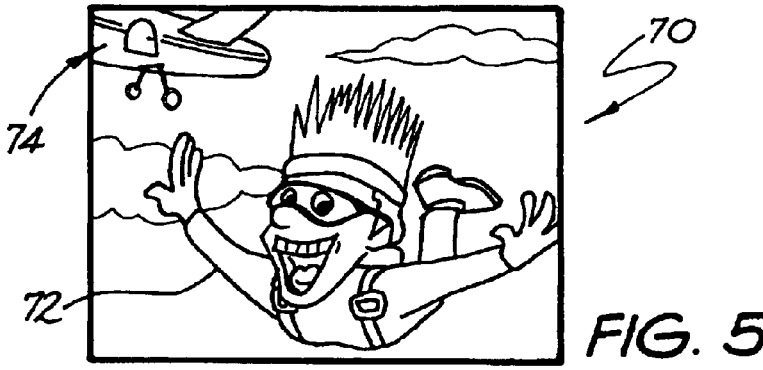
Figure 5C:
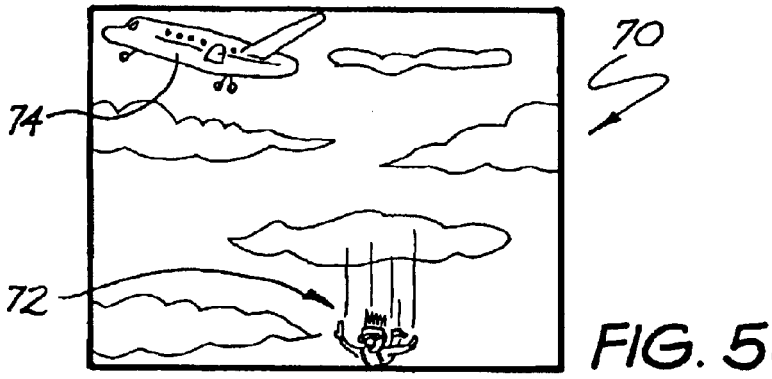

Once the skydiver 72 has left the aeroplane 74, as shown in FIG. 5*b* of the drawings, the animation sequence is such that, when the skydiver 72 is falling, as shown in FIG. 5*c* of the drawings, the ground is not shown so that the player is unable to judge how much time the player has to stop the animation. Also, different animations may apply for opening the parachute. For example, one may open straight away whilst, in another animation, the skydiver 72 may get caught in a crosswind and, as a result, take longer to open the parachute. It may also occur that the parachute fails to open even if the button has been pressed by the player. In so doing, random factors influence the player's skill making the feature less predictable.

Figure 5D:
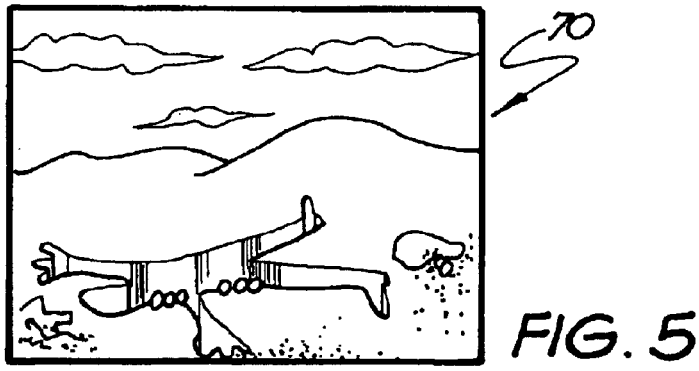

In the example illustrated, it is assumed that the machine offers a prize between one hundred and two hundred credits. If, during the interval shown in FIG. 5*c*, the meter reaches two hundred before the player has hit the button, then the player will have failed. The animation as shown in FIG. 5*d* of the drawings will be displayed on the display screen 70 and the consolation prize of ten credits will be awarded.

If the player presses the button before the maximum credits have been reached, the internal meter will stop incrementing immediately. Another random number is selected in the range 1 to 5 to determine whether or not a success will be awarded. The options corresponding to the numbers 1 to 5 are the following:

Option 1: parachute opens safely and skydiver 72 sails safely to earth;

Option 2: skydiver 72 fails an initial attempt to open the parachute but eventually does and sails safely to earth:

Option 3: skydiver 72 cannot open the parachute but amid a fit of panic manages to open it only just before landing on the ground;

Option 4: commences the same as Option 3, but this time the skydiver hits the ground before the parachute opens with the parachute landing on top of the skydiver 72: and Option 5: commences the same as Option 4 except that the parachute never opens at all.

If the random number selected relates to Options 1, 2 or 3 then the appropriate animation will be played and the player will be paid the amount that is on the internal meter. However, if Options 4 or 5 are chosen, then the appropriate animation will be played and only the consolation prize will be paid.

Figure 6:
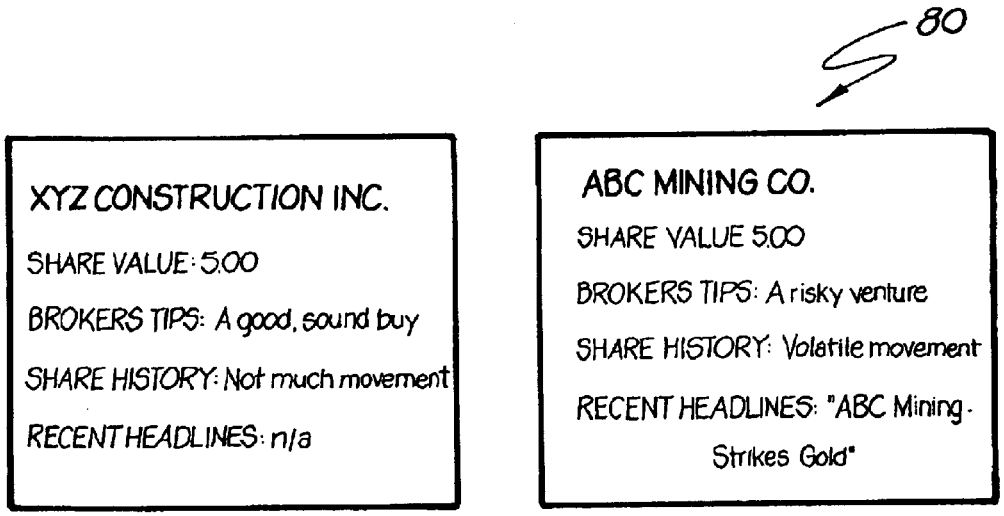
FIG. 6 shows a first screen display of a third embodiment of a feature game played on the gaming machine of FIG. 1.

In yet a further embodiment of the invention, a current meter amount may be paid whether frozen by the player or not. Further, the amount on the meter may vary in a non-uniform manner rather than incrementing at a fixed rate. The preferred embodiment for this feature game is a stock market game. The player is offered a variety of share options to choose from as shown in FIG. 6 of the drawings. The player is then be able to adjust the value of the prize by watching the fluctuating share prices and selling when the player is happy with the value. A fixed period of time, for example, thirty seconds, is given during which the player presses a button to sell that player's shares at any time. The value of the shares will vary within this time and animations will be used to support the fluctuations in the share values.

If the player presses the "sell" button within the fixed period of time the player will be paid a prize which is the share price at the time that the button was pressed multiplied by the number of shares that the player has. If, however, the fixed period of time expires before the player has pressed the button, the player will be paid the value of the shares at the time that the fixed period of time expired multiplied by the number of shares that the player has.

The stock market feature game works as a second screen feature following a base game. The base game has three different methods of triggering the feature. The method by which the feature is triggered will determine the number of shares awarded. For example, five scatter symbols commences the feature with thirty shares, four scatter symbols with ten shares or three scatter symbols with five shares.

A second screen 80 is displayed showing information on the shares of two different companies as shown in FIG. 6 of the drawings. Each share is initially valued at the same price. The player chooses the company in which to buy shares. To enable the player to make a selection, information for each company will include broker's tips and recent headlines that will serve to give the player advice about the volatility of each of the shares.

Figure 7:
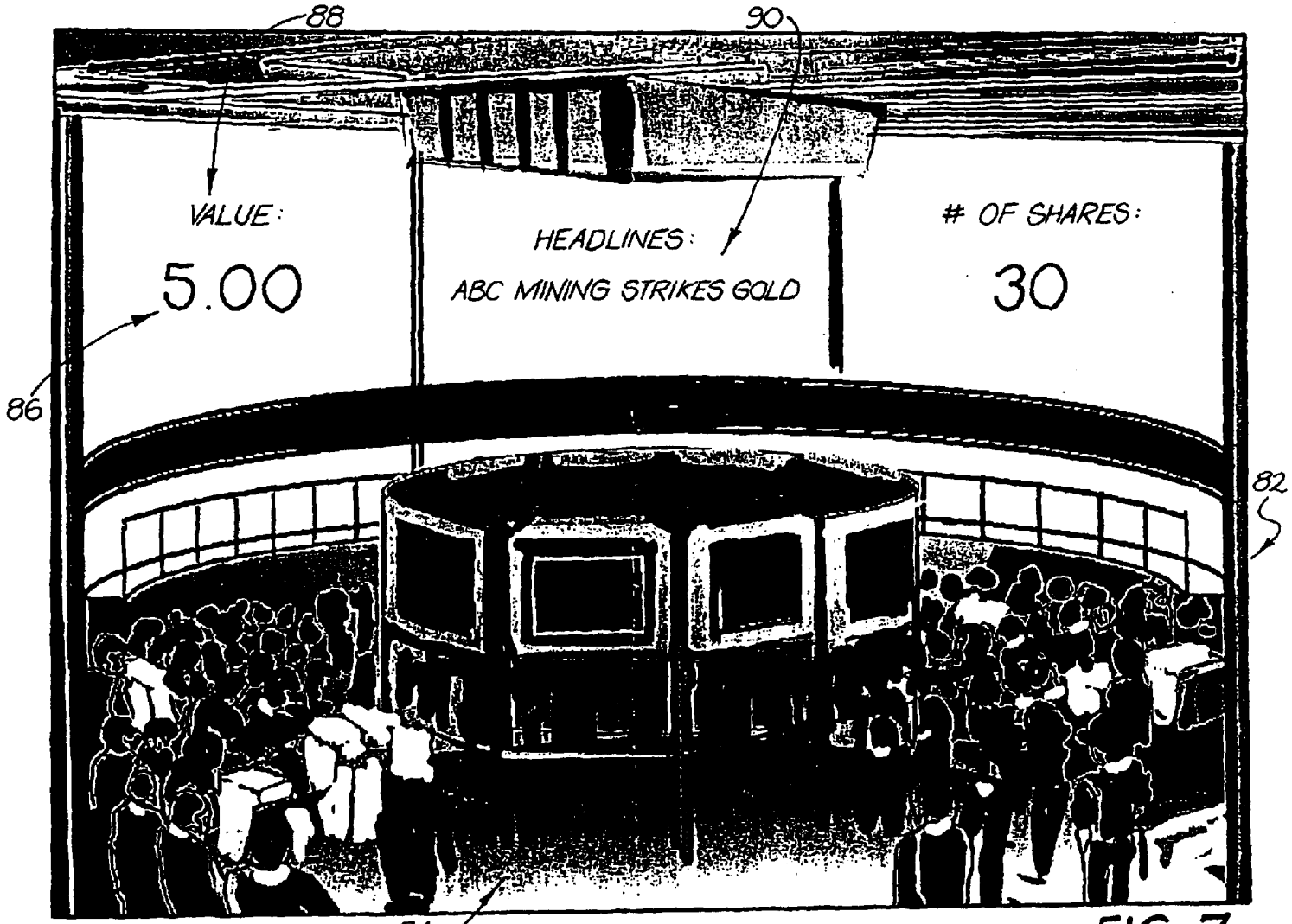
FIG. 7 shows a second screen display of the third embodiment of the feature game.
Figure 8:
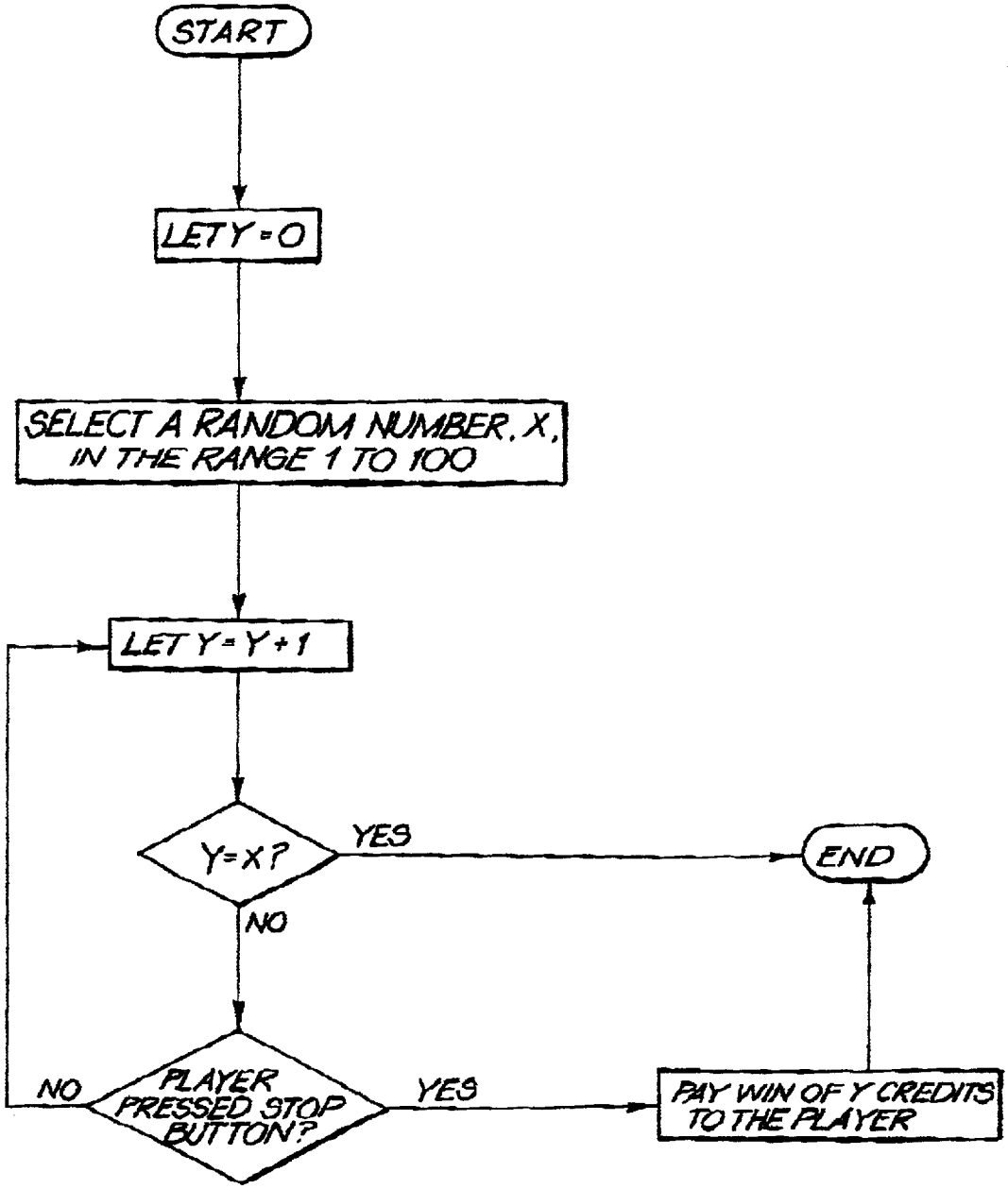
FIG. 8 shows a flow chart of the game of FIGS. 3 and 4.
Figure 9:
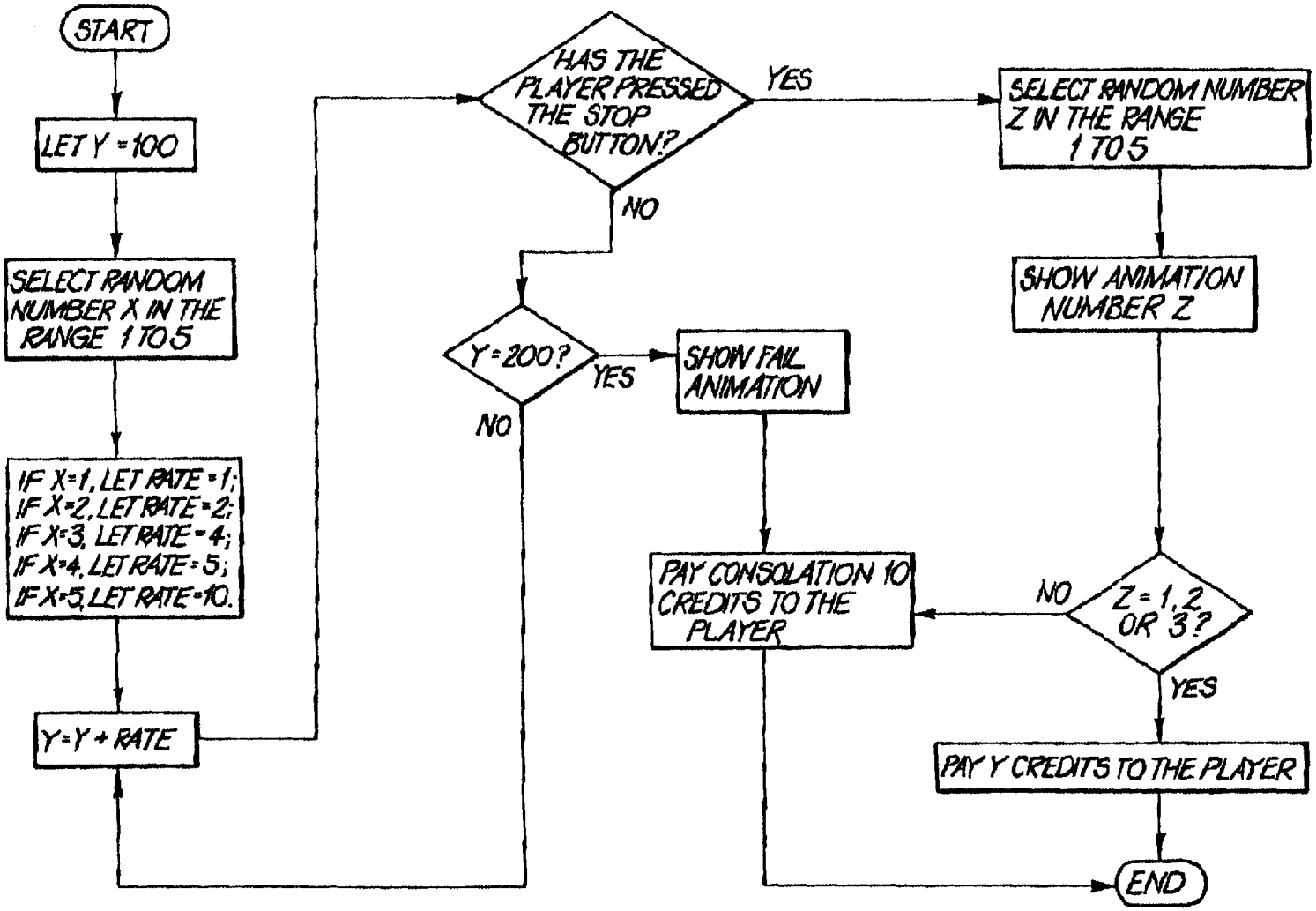
FIG. 9 shows a flow chart of the game of FIG. 5.
Figure 10:
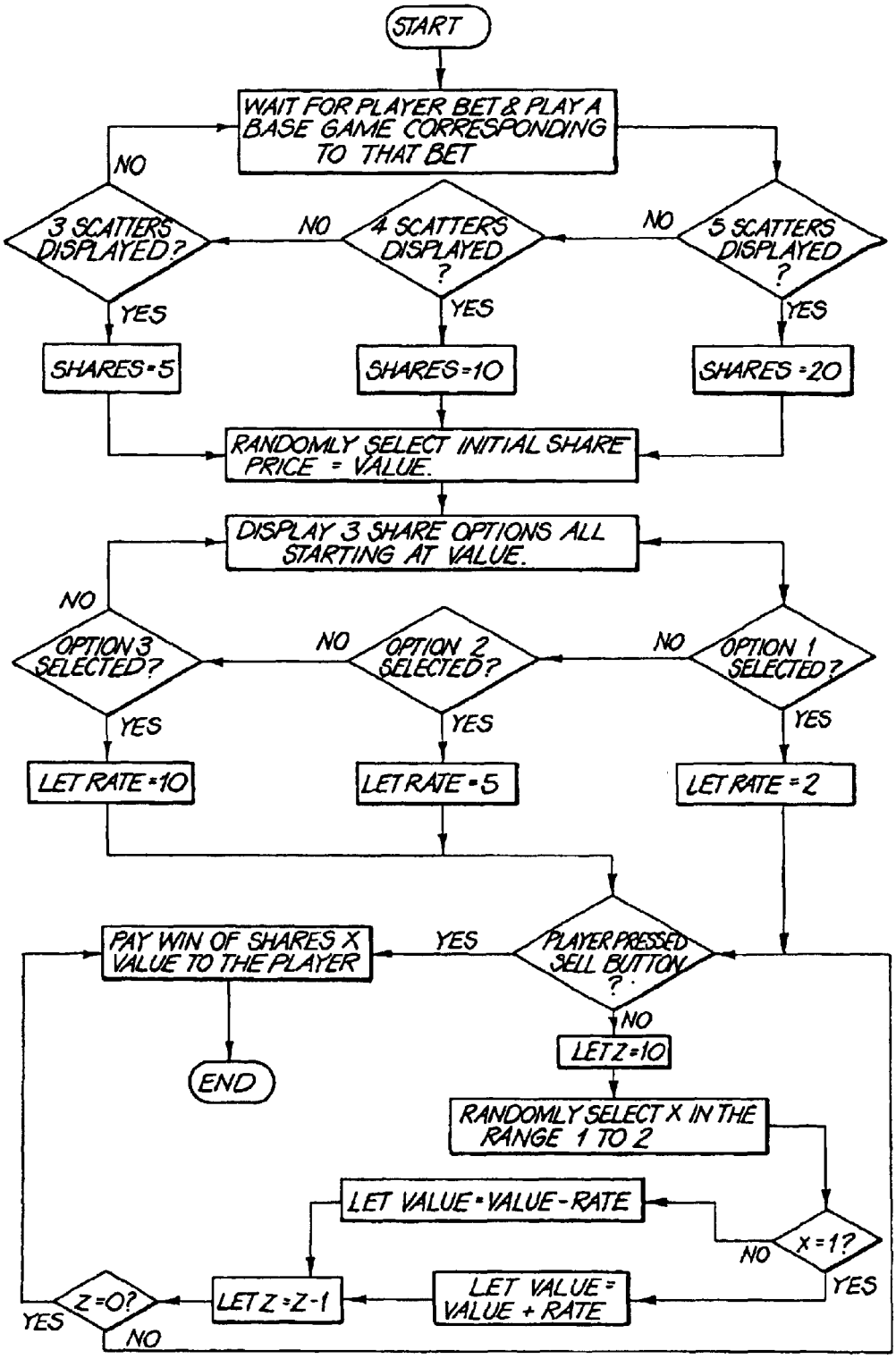
FIG. 10 shows a flow chart of the game of FIGS. 6 and 7.

When the shares have been chosen, another screen 82 is displayed showing a stock exchange floor 84 as illustrated in FIG. 7 of the drawings. Signs 86 are positioned around the stock exchange floor 84 showing headlines relating to the shares that the player has purchased. A message is displayed requesting the player to press one of two buttons, being a "Start Feature" or a "Sell" button. If the player, immediately after the commencement of the feature, presses the "Sell" button then the player will be paid out the value of the shares as they were given to the player in the previous screen 80 and the feature will terminate. If the player presses the "Start Feature" button, a meter 88 is displayed which reflects the current value of the shares. Another meter (not shown) displays the total amount that the player has being the share value multiplied by the number of shares. The signs 86, such as a message 90, begin to change and the two meters will change value by either going up or down depending on the messages displayed.

As an indication, the company is a mining company which strikes gold. This causes the share price to go up. Instead, the mine may be flooded which causes the share price to drop.

In another example (not illustrated), the company is a museum and messages displayed may relate to a rare fossil being found by the museum which causes the share price to go up. On the other hand, an earthquake may destroy a billion dollar excavation site leading to the share price going down.

The direction of the share value movement and possibly the speed at which it moves will be randomly chosen and will change throughout the feature.

If ten changes in share value occur without the player having pressed the "Sell" button, then the day's end of trading will be reached and the player will be forced to sell the shares. Also, the player will be paid the price of the shares when the fixed period of time terminates multiplied by the number of shares that the player has. In contrast, if the player presses the "Sell" button during the thirty second period, the player is paid the value of the shares multiplied by the number of the shares at the time that the "Sell" button was pressed and the feature terminates.

Hence, it is an advantage of the invention that a game feature is provided which will enhance player excitement and which, by player skill, can improve the return to the player.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A gaming machine having a display means and a game control means arranged to control images displayed on the display means, the game control means being arranged to play a game wherein one or more random events are caused to be displayed on the display means and, if a predefined winning event results, the machine awards a prize, the gaming machine further including a feature of a changing representation of the awarding of the prize and a player-operable control device which, upon manipulation by a player, controls an outcome of the feature to determine an amount awarded to the player, the game control means selecting a threshold value so that the prize, if any, awarded to the player is dependent on when, during the changing of the representation, the player operates the control device with a losing outcome resulting if the player operates the control device after the threshold value has been reached.

2. The gaming machine of claim 1 in which the representation is a representation of a win meter.

3. The gaming machine of claim 1 in which the representation is a graphical display representing a changing award.

4. The gaming machine of claim 3 in which the amount represented by the graphical display, where it is stopped by the player, is awarded to the player as the prize.

5. The gaming machine of claim 1 in which the graphical display commences changing and the player is able to stop the graphical display at any time by means of the control device, the arrangement being such that, if the graphical display reaches the threshold value, the losing outcome results but, if the player operates the control device before the threshold value is reached, the player is awarded the amount represented by the graphical display at the time that the control device is operated.

6. The gaming machine of claim 5 in which the rate at which the graphical display changes is variable and is set by the game control means.

7. The gaming machine of claim 5 in which the game control means is operable to cause the losing outcome to result even if the player operates the control device before the threshold value has been reached.

8. The gaming machine of claim 5 in which, should the player stop the representation before the threshold value is reached, the game control means causes the selected threshold value to be displayed so that the player can ascertain when the losing outcome would have resulted.

9. The gaming machine of claim 1 in which a random number is selected as the threshold value by the game control means, the random number falling in a predetermined range from one to a highest possible value.

10. The gaming machine of claim 9 in which the graphical display commences changing and the player is able to stop the graphical display at any time by means of the control device, the arrangement being such that, if the graphical display reaches the threshold value, the losing outcome results but, if the player operates the control device before the threshold value is reached, the player may be awarded the amount represented by the graphical display at the time that the control device is operated.

11. The gaming machine of claim 10 in which the rate at which the graphical display changes is variable and is set by the game control means.

12. The gaming machine of claim 10 in which the game control means is operable to cause the losing outcome to result even if the player operates the control device before the threshold value has been reached.

13. The gaming machine of claim 10 in which, should the player stop the representation before the threshold value is reached, the game control means causes the selected threshold value to be displayed so that the player can ascertain when the losing outcome would have resulted.

14. The gaming machine of claim 1 in which the control device is an actuator operable by the player to stop changes in the representation.

15. The gaming machine of claim 1 in which the feature is triggered upon the occurrence of a trigger condition arising in a base game.

16. The gaming machine of claim 1 in which the feature is played as a tournament across a bank of linked gaming machines.

17. A gaming machine having a display means and a game control means arranged to control images displayed on the display means, the game control means being arranged to play a game wherein one or more random events are caused to be displayed on the display means and, if a predefined winning event results, the machine awards a prize, the gaming machine further including a feature having a prize awarding phase during which a changing animation sequence, representative of the awarding of the prize, is displayed, the game control means selecting a threshold value which, at least initially, is hidden from a player and the gaming machine including a player-operable control device which is operated by the player to stop the sequence to determine an amount awarded to the player, the prize, if any, awarded to the player being dependent on when, during the animation sequence, the player operates the control device and a losing outcome resulting if the player operates the control device after the threshold value has been reached, the animation sequence displaying the losing outcome.

* * * * *